US005209409A

United States Patent [19]

Neiss

[11] Patent Number: 5,209,409

[45] Date of Patent: May 11, 1993

[54] SANDBLAST NOZZLE WITH WEAR RESISTANT SEALING DEVICE AND LOCK-ON MECHANISM

[76] Inventor: Lynn R. Neiss, 4680 Alabama Ave. SW., Navarre, Ohio 44662

[21] Appl. No.: 803,341

[22] Filed: Dec. 4, 1991

[51] Int. Cl.[5] ..... B24C 5/02

[52] U.S. Cl. ..... 239/586; 239/530; 51/427; 51/438; 51/439; 251/299

[58] Field of Search ..... 239/525, 530, 586, 506, 239/288; 251/299, 111, 154; 51/427, 439, 438

[56] References Cited

U.S. PATENT DOCUMENTS

| | | | |
|---|---|---|---|
| 191,964 | 6/1877 | Holloway | 239/506 |
| 2,852,310 | 9/1958 | Francis | 239/530 |
| 3,047,986 | 8/1962 | McKulla, Jr. | 51/439 |
| 3,618,263 | 11/1971 | Weijsenburg | 51/427 |
| 4,269,359 | 5/1981 | Neiss | 239/530 |
| 4,286,755 | 9/1981 | Shipman | 239/530 |
| 4,947,589 | 8/1990 | Zwicker | 51/439 |

FOREIGN PATENT DOCUMENTS

| | | | |
|---|---|---|---|
| 3617035 | 11/1987 | Fed. Rep. of Germany | 51/427 |

*Primary Examiner*—Andres Kashnikow
*Assistant Examiner*—Karen B. Merritt
*Attorney, Agent, or Firm*—Renner, Kenner, Greive, Bobak, Taylor & Weber

[57] ABSTRACT

A sandblast nozzle is provided with a wear resistant sealing device and a lock-on mechanism. A lever arm is pivotally positioned with respect to a ceramic nozzle. A sealing member is maintained at the end of the lever arm. The sealing member consists of a rubber sealing surface having a wear piece along at least one peripheral edge thereof, that peripheral edge being the first to engage a stream of sand from the nozzle during the closing operation. The wear piece is preferably of hardened steel or ceramic. Square or rectangular seal blocks are employed in the concept of the invention, along with cylindrical seal blocks and discs. Additionally, a lock ring may be maintained upon the sandblast nozzle assembly and rotatable with respect to the axis thereof to engage the lever in an "open" position, to override the biasing of a spring which normally urges the lever to a "closed" position.

16 Claims, 2 Drawing Sheets

FIG.-1
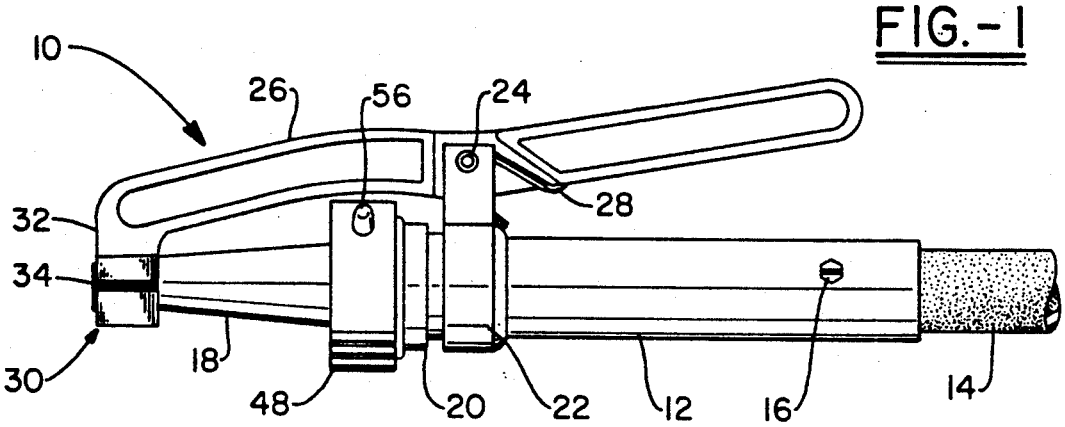
FIG.-5
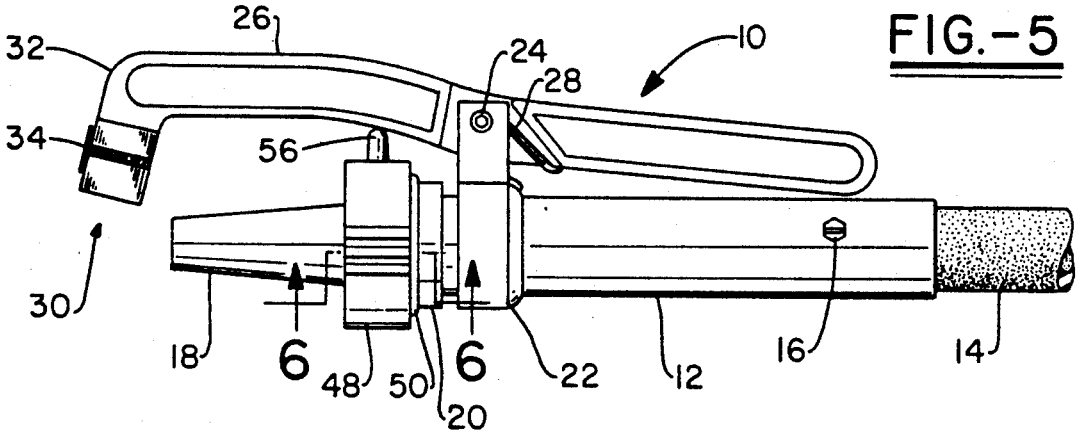
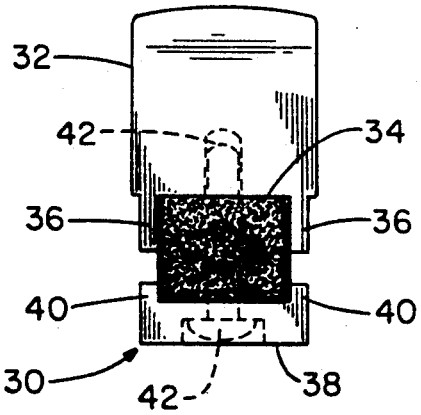
FIG.-2
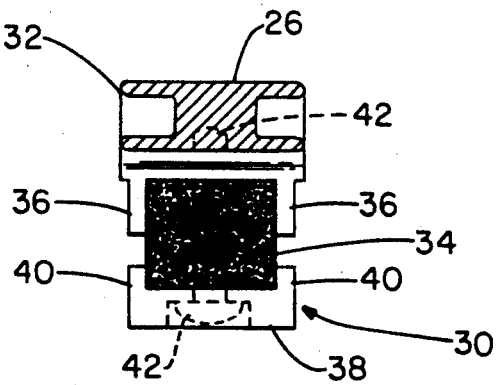
FIG.-3

SANDBLAST NOZZLE WITH WEAR RESISTANT SEALING DEVICE AND LOCK-ON MECHANISM

TECHNICAL FIELD

The invention herein resides in the art of sandblast valves and, more particularly, to improvements therein. Specifically, the invention relates to an improved stop block for the valve or a sandblast nozzle and a lock-on mechanism for such a nozzle having a valve of the deadman type.

BACKGROUND ART

The present state of the art of sandblast nozzle is substantially as shown and taught by U.S. Pat. No. 4,269,359, owned by the applicant herein. In such sandblast nozzles, a hose is provided for carrying sand or other abrasive granular material under pressure from a source of such material at one end to the valve mechanism at the other. This valve mechanism presently comprises a tubular metal handle receiving the hose in one end thereof and having a ceramic nozzle at the opposite end. A lever is pivotally mounted to the handle, such lever having one end positioned for engagement by the operator's hand, and the opposite end being provided with an appropriate sealing member for selective engagement with the nozzle orifice.

The sealing member of presently known sandblast valves has typically included a "stop block" or "seal block" of rubber or other resilient material to be brought into contacting engagement with the end of the nozzle and to close the nozzle orifice. Such closure is achieved by simple release of the lever arm, with a spring biasing the lever arm into the closed position. The operator's hand, operating upon the lever and against the bias of the spring, achieves the opening of the valve.

In the prior art, it has been most desirable that the seal blocks of the valve members be of a resilient material such as rubber or the like in order to prevent chipping of the ceramic nozzle when the lever arm is released and the stop block forcefully engages the nozzle tip. However, abrasive material such as employed in sandblasters rapidly destroys the resilient seal block. The time required for such destruction is generally a function of the quickness of the closing action. Operators who slowly close the valve by regulated release of hand pressure on the lever arm more quickly wear out the sealing block than those operators who instantaneously release the lever arm, allowing the spring to attain immediate closure. In any event, it has been found in the prior art that an average operator of such sandblast nozzles would wear out the surface of a seal block after fifty openings/closings of the nozzle. As a result of such wear, the prior art has sought to employ cylindrical or rectangular seal blocks which may be rotated to progressively expose virgin surfaces to the nozzle tip when the prior surface has been worn by the sand. Such seal blocks have typically been mounted axially on a bolt so that they can be rotated to expose the new sealing face when the face wears. However, even utilizing such seal blocks, it has been found that only two hundred openings and closings of the nozzle can typically be achieved without having to totally change the seal block. Of course, it is understood that after each fifty openings and closings the seal block would necessarily be rotated to expose a new face.

Additionally, the prior art has taught the implementation of a deadman valve in the sandblast industry. The state of the art sandblast valve as taught in U.S. Pat. No. 4,269,359 is of such a nature. When the valve is released from the operator's hand, the lever arm automatically closes the valve to prevent sand from being emitted from the nozzle. However, the need of the operator to continually depress the lever gives rise to operator fatigue, since the lever must be constantly urged against the biasing spring. When it is required that the sandblast valve be opened for extended periods of time, there is a need to override the deadman feature. It has been found that most large valves are of sufficient weight that an overriding of the deadman feature does not pose a serious safety problem, since the large valve will not whip around at the end of the hose as by backlash or the like when they are dropped during operation with the valve open. Only the lighter valves have been known to demonstrate such undesirable characteristics and, in those valves, an overriding of the deadman feature is not desirable.

DISCLOSURE OF INVENTION

In light of the foregoing, it is a first aspect of the invention to provide a sandblast valve having a resilient stop block which can be reused despite wear.

Another aspect of the invention is the provision of a sandblast valve which incorporates a resilient stop block with associated means for extending and enhancing the life thereof.

A further aspect of the invention is the provision of a sandblast valve which includes a wear plate or surface in juxtaposition to the resilient stop block to impede the flow of abrasive granular material prior to cessation at the stop block, thereby protecting the stop block and significantly extending its life.

Still a further aspect of the invention is the provision of a sandblast valve which includes a lock-on mechanism to keep the valve open without continued actuating activity by the operator.

An additional aspect of the invention is the provision of a sandblast valve which may selectively function as a deadman valve, or one with a lock-on feature.

Another aspect of the invention is the provision of a sandblast valve which is reliable in operation, cost effective to manufacture, and consistent with state of the art technology.

The foregoing and other aspects of the invention which will become apparent as the detailed description proceeds are achieved by a sandblast valve, comprising: a nozzle in communication with a source of sand under pressure and adapted to pass such sand therethrough; a lever arm; and a sealing member at an end of said lever arm, said lever arm being adapted to move said sealing member into and out of sealing engagement with said nozzle, said sealing member comprising a resilient block having a wear piece attached thereto.

Other aspects of the invention which will become apparent herein are attained by a sandblast valve, comprising: a nozzle in communication with a source of sand under pressure; a lever arm having a sealing member at an end thereof, said lever arm biased to urge said sealing member into sealing engagement with said nozzle; and blocking means interposed between said lever arm and said nozzle for preventing closure of said lever arm with said nozzle under urging of said bias.

DESCRIPTION OF DRAWINGS

For a complete understanding of the objects, techniques, and structure of the invention, reference should be made to the following detailed description and accompanying drawings wherein:

FIG. 1 is a side elevational view of the sandblast valve according to the invention in its closed position;

FIG. 2 is a partial front view of a sandblast valve of FIG. 1, showing the stop block thereof;

FIG. 3 is a partial elevational view of the stop block portion of the sandblast valve of FIG. 1 as viewed from the nozzle of the sandblast valve;

FIG. 5 is a side elevational view of a sandblast valve of the invention in its open position;

BEST MODE FOR CARRYING OUT THE INVENTION

Figure 4:
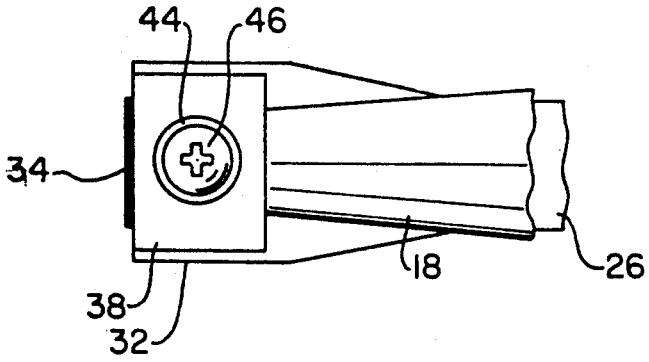
FIG. 4 is a bottom view of the engagement of the nozzle and stop block per the invention.

Referring now to the drawings and more particularly FIG. 1, it can be seen that a sandblast valve according to the invention is designated generally by the numeral 10. The assembly 10 includes a tubular handle 12 which is preferably made of metallic pipe or the like. Received within one end of the tubular handle 12 is a sandblast hose 14 of the type well known and understood by those skilled in the art and which communicates with a source of sand or other abrasive granular material under pressure for passing therethrough. The sandblast hose 14 is maintained within the tubular handle 12 by means of an appropriate screw 16 or other appropriate fastening means.

A ceramic nozzle 18 is received at the end of the tubular handle 12 opposite that end receiving the hose 14. A nozzle nut 20 is threaded onto the end of the tubular handle or pipe 12 to secure the ceramic nozzle 18 thereto. Of course, it is preferred that the nozzle 18 be ceramic to accommodate the abrasive nature of the materials passed therethrough.

Encompassing the pipe 12 and affixed thereto is a collar 22 having a pivot pin 24 passing through a flange or flanges extending therefrom. The pivot pin 24 passes through an upper arm 26 which is biased by an appropriate spring 28 which, at one end thereof, engages a rearward portion of the lever 26, with the other end being connected to the pivot pin 24, collar 22, or pipe 12. As shown in FIG. 1, an end 32 of the upper arm 26 is angled downwardly from the principal axis of the lever arm 26 and receives a sealing member 30 extending therefrom. As will be readily appreciated by those skilled in the art, the spring 28 normally urges the lever 26 into the position in FIG. 1 such that the sealing member 30 engages the tip of the nozzle 18, blocking the orifice thereof and thereby preventing sand from passing therethrough. The valve 10 may be opened by depressing the rearward portion of the upper arm 26 against the biasing spring 28 to raise the sealing member 30 from blocking the orifice of the nozzle 18.

With reference now to FIG. 2, it can be seen that the sealing member 30 comprises a seal block 34 which is preferably of a resilient material such as rubber or the like which will not chip or otherwise damage the ceramic nozzle 18 when brought into forceful contact therewith. A pair of flanges 36 depend downwardly from the end 32 of the lever arm 26 on either side of the seal block 34 at a top portion thereof. A channel member 38 having a pair of channels 40 on opposite sides thereof engages the seal block 34 at a bottom portion thereof as shown. A screw 42 or other appropriate securing means passes through the channel 38 and is threadedly received by the end 32 of the lever arm 26. In the preferred embodiment, the screw 42 passes axially through the center of the seal block 34. It should be apparent to those skilled in the art that the flanges or ears 36 extending downwardly from the end 32 of the lever arm 26 prevents any rotational movement of the stop block 34, while tightening of the screw 42 prevents any axial movement thereof. Accordingly, the stop or seal block 34 is maintained between the end 32 and the channel 38.

FIG. 3 illustrates the working side of the seal block 34 that engages the nozzle tip of the nozzle 18 to seal the orifice thereof. In the preferred embodiment of the invention, this working face is substantially coplanar with the end surfaces of the channel 38 and end 32 of the lever arm 26. It will also be appreciated from FIG. 4 that the screw 42 is preferably countersunk as at 44 so that the screw head 46 is received below the external surface of the channel 38 and is thereby protected from the sand emitted from the nozzle 18 during the opening and closing operations. It has been found that the exposure of the head 46 of the screw 42 may allow the screw head to be destroyed by contact with the sand over a course of time, such destruction resulting in separation of the channel 38 from the block 34, rendering the valve 10 inoperative.

Figure 6:
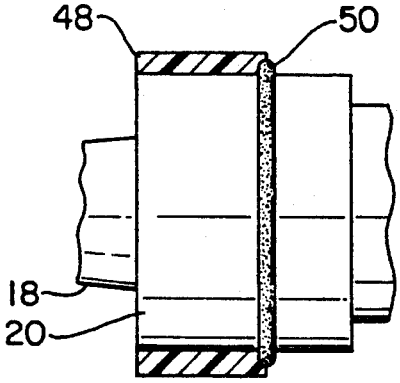
FIG. 6 is a partial sectional view of a nozzle nut, lock ring and retaining O-ring taken along the line 6—6 of FIG. 5.
Figure 7:
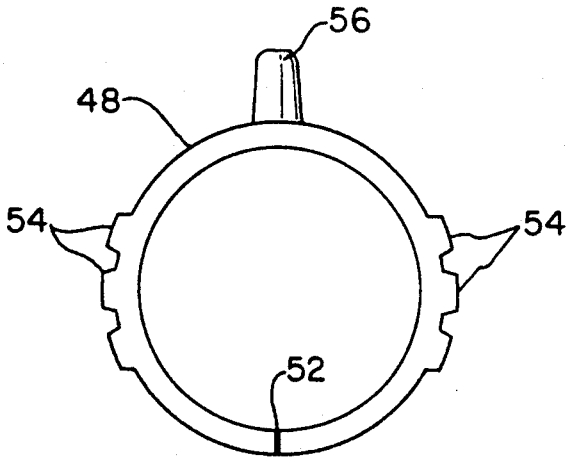
FIG. 7 is a front elevational view of a lock-on ring according to the invention.

With reference now to FIG. 5, it can be seen that a portion of the invention includes a lock ring 48 received upon the nozzle nut 20 and rotatable thereabout. In a preferred embodiment of the invention, the lock ring 48 is of plastic construction and the nozzle nut 20 is metallic. As shown in FIG. 6, the ring 48 is slidingly received upon the nut 20, with the axial positioning of the lock ring 48 being limited by means of an O-ring 50 received within a groove and circumferentially extending about the nut 20. Further, in the preferred embodiment of the invention the internal diameter of the lock ring 48 is preferably slightly less than the outside diameter of the nut 20 such that a friction fit exists between the two while allowing rotation of the lock ring 48 upon the nut 20. To facilitate placement of the lock ring 48 upon the ring 20, the ring 48 may be split as at 52 so that it may be slightly opened for positioning upon the nut 20, with the plastic ring 48 then closing thereabout. Such feature is shown in FIG. 7, along with knurled edges 54 which may accommodate gripping by the operator for rotating the ring 48. Finally, a finger or other appropriate protrusion 56 extends from an outer circumferential surface of the ring 48 as shown.

In operation of the embodiment just described, the valve 10 is connected through the hose 14 to an appropriate source of sand or other granular material maintained under pressure. The sealing member 30 is engaged with the nozzle 18 to close the same as by the biasing spring 28. The valve 10 is opened by the operator depressing the rearward portion of the lever arm 26 extending toward the hose 14. Such actuation about the pivot pin 24 causes the sealing member 30 to move upwardly in an arc away from the tip of the nozzle 18. Sand immediately begins to flow from the nozzle 18 under force generated at the pressurized source. When the operator desires to close the valve, he may simply release the lever arm 16, causing the sealing element 30 to snap into contact with the nozzle 18, or he may slowly release the lever arm. In either even, the face edge of the channel 38 first comes into alignment with the orifice of the nozzle 18 and in close juxtaposition therewith. This face edge substantially breaks up and terminates the flow of the abrasive sand such that little force and volume of sand flow is experienced by the working face of the seal block 34 as it then comes into sealing contact with the tip of the nozzle 18.

It has been found that the use of the channel 38 as a wear piece, or any other appropriate wear piece on the leading edge of the sealing block as it passes into the sand stream greatly increases and enhances the life of each of the wear surfaces of the seal block and, accordingly, of the seal block as a whole. By forming the wear piece or channel 38 of hardened steel, ceramic (aluminum oxide, silicon carbide, or boron carbide) the wear piece 38 can have a very substantial life. It has been found in operation that the life of each of the surfaces of the seal block 34 is extended tenfold, correspondingly extending the life of the seal block 34 as a whole by the same amount. Accordingly, the channel member 38 serves not only as the bottom support for the seal block 34, but also as a wear piece and an initial blocking portion of the sealing member 30.

With further attention to the operation of the invention, it will be appreciated that the lock ring 48 allows one to override the deadman feature of the valve 10, if so desired. To achieve this, the operator need only open the valve as shown in FIG. 5 by depressing the rear end of the lever 26 extending toward the hose 14 into close juxtaposition with the pipe handle 12. With the valve open, lock ring 48 may be rotated such that the finger 56 is in alignment with the lever arm 26 such that release of the lever arm 26 by the operator results in engagement between the finger 56 and the lever arm 26, maintaining the sealing element 30 away from the tip of the nozzle 18. Further rotation of the lock ring 48 such that the finger or protrusion 56 extends on either side of the lever arm 26 will allow the valve 10 to again operate in its standard deadman fashion.

Figure 8:
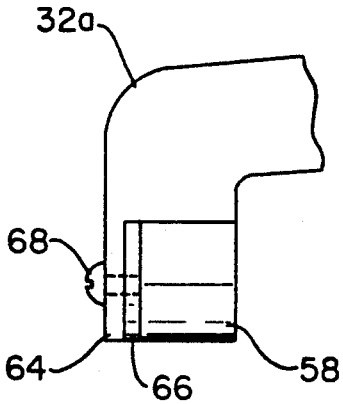
FIG. 8 is a partial side elevational view of the second embodiment of a stop block according to the invention.
Figure 9:
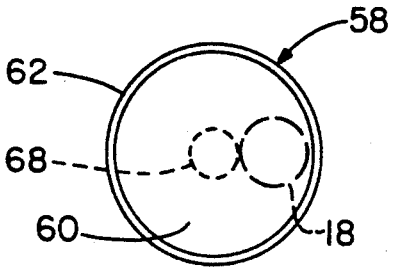
FIG. 9 is an illustrative view of the stop block of FIG. 8 as viewed by the nozzle of the sandblast valve.

It is also contemplated as a portion of the invention that other embodiments of seal blocks may be employed. It has previously been known in the art to employ rubber cylinders or rubber discs as the seal block element. Such devices may be enhanced in accordance with the teachings of the instant invention by providing a wear portion in association therewith. As shown in FIGS. 8 and 9, a seal block 58 may be provided in the form of a resilient cylinder such as rubber or the like which is received within a metallic tube 62 about the circumference thereof and substantially flush with an operative sealing face. In this embodiment, a front flange 64 of an end portion 32*a* of a modified lever arm 26 may extend downwardly to receive a screw 68 passing therethrough and into engagement with a metallic disc 66 which is secured to an end of the seal block 58. In the preferred embodiment, the metallic disc 66 is threaded for receipt by the screw 68. Accordingly, when the screw 68 is loosened, the cylindrical seal block 58 may be rotated about the axis of the screw 68.

In the preferred embodiment of the invention, the seal block 58 is secured to the flange 64 in such a manner that the seal block 58 is not coaxial with the tip of the nozzle 18 (shown in phantom in FIG. 9) when the seal block 58 engages such tip when the valve 10 is closed. In other words, the seal block 58 is eccentric with respect to the axis of the nozzle 18.

It will now be apparent to those skilled in the art that the cylindrical seal block 58 may be employed to provide a number of sealing surfaces in the manner described above with respect to the embodiment shown in FIGS. 1–4. As the valve 10 is closed, an exposed edge of the metallic pipe 62 first engages the sand stream, breaking up the same and substantially stopping its flow. The working end or face of the resilient rubber cylinder 60 then comes into contacting sealing engagement with the tip of the nozzle 18, greatly extending the life of that portion of the wear surface. When a groove has eventually worn into that portion of the wear surface, the screw 68 is loosened and the cylindrical seal block 58 is rotated to bring another portion of the working surface of the resilient cylinder 60 into sealing alignment with the tip of the nozzle 18. It has been found that at least three such rotations of 90° each may be employed to obtain at least four wear adjustments from a single cylindrical seal block 58.

It will be readily appreciated by those skilled in the art that the seal block 58 may, indeed, be a disc rather than a cylinder, the only difference being the length of the seal block 58. In such case, the resilient member 60 would be a disc and the tube 62 would be replaced by a ring. In all other respects, the operation of the valve would be the same as just described.

Thus it can be seen that the objects of the invention have been satisfied by the structure presented above. While in accordance with the patent statutes only the best mode and preferred embodiments of the invention have been presented and described in detail, it is to be understood that the invention is not limited thereto or thereby. Accordingly, for an appreciation of the true scope and breadth of the invention reference should be made to the following claims.

What is claimed is:

1. A sandblast valve, comprising:

a nozzle in communication with a source of sand under pressure and adapted to pass such sand therethrough;

a lever arm; and a sealing member at an end of said lever arm, said lever arm being adapted to move said sealing member into and out of sealing engagement with said nozzle, said sealing member comprising a resilient rectangular block having a wear piece attached thereto, said wear piece comprising a plate received on one end of said rectangular block, said rectangular block being selectively rotatable about a pin extending therethrough and said rotation exposing selected sides of said block to said nozzle, wherein said nozzle emits said sand in a stream, said wear piece being positioned to engage said stream before said resilient block engages said stream upon sealing actuation of said sealing member.

2. The sandblast valve according to claim 1, wherein said wear piece is metallic.

3. The sandblast valve according to claim 1, wherein said wear piece is ceramic.

4. A sandblast valve, comprising:

a nozzle in communication with a source of sand under pressure;

a lever arm having a sealing member at an end thereof;

biasing means engaging said lever arm for urging said sealing member into sealing engagement with said nozzle; and locking means interposed between said lever arm and said nozzle for preventing closure of said lever arm with said nozzle under urging of said biasing means, said locking means comprising a finger selectively engageable with said lever arm and a ring carrying said finger, said ring being rotatable about an axis.

5. The sandblast valve according to claim 4, wherein the said ring is received and rotatable about a handle of the valve.

6. The sandblast valve according to claim 5, wherein said ring is received upon and rotatable about a nut which threadedly secures said nozzle to said handle.

7. The sandblast valve according to claim 6, wherein said ring is split.

8. The sandblast valve according to claim 7, wherein said nut has a stop restricting axial movement of said ring upon said nut.

9. The sandblast valve according to claim 8, wherein said stop comprises an "O" ring received within a circumferential groove about said nut.

10. The sandblast valve according to claim 9, wherein said sealing member comprises a seal block having a wear piece attached thereto, said wear piece positioned to first come into juxtaposition with said nozzle upon said closure of said lever arm with said nozzle.

11. A sandblast valve, comprising:

a nozzle in communication with a source of sand under pressure and adapted to pass such sand therethrough;

a lever arm; and a sealing member at an end of said lever arm, said lever arm being adapted to move said sealing member into and out of sealing engagement with said nozzle, said sealing member comprising a resilient cylindrical block having a wear piece attached thereto, said wear piece being tubular and axially receiving said cylindrical block, said cylindrical block and said nozzle not being coaxial during any state of operation of the valve, and wherein said nozzle emits said sand in a stream, said wear piece being positioned to engage said stream before said resilient block engages said stream upon sealing actuation of said sealing member.

12. A sandblast valve according to claim 11, wherein said wear piece is metallic.

13. The sandblast valve according to claim 11, wherein said wear piece is ceramic.

14. A sandblast valve, comprising:

a nozzle in communication with a source of sand under pressure and adapted to pass such sand therethrough;

a lever arm; and a sealing member at an end of said lever arm, said lever arm being adapted to move said sealing member into and out of sealing engagement with said nozzle, said sealing member comprising a resilient disc block having a wear piece attached thereto, said wear piece comprises a ring circumferentially surrounding said disc, said disc and said nozzle not being coaxial during any state of operation of the valve; and wherein said nozzle emits said sand in a stream, said wear piece being positioned to engage said stream before said resilient block engages said stream upon sealing actuation of said sealing member.

15. The sandblast valve according to claim 14, wherein said wear piece is metallic.

16. The sandblast valve according to claim 14, wherein said wear piece is ceramic.

* * * * *